United States Patent [19]

Höck et al.

[11] 4,269,701

[45] May 26, 1981

[54] CYCLONE SEPARATOR FOR THE REMOVAL OF HEAVY PARTICLES AND DUST PARTICLES FROM FIBRE MATERIAL

[75] Inventors: Franz Höck, Overath; Franz-Herbert Döpper, Bergisch Gladbach; Gert Stock, Cologne, all of Fed. Rep. of Germany

[73] Assignee: Temafa Textilemaschinenfabrik GmbH, Fed. Rep. of Germany

[21] Appl. No.: 69,637

[22] Filed: Aug. 27, 1979

[30] Foreign Application Priority Data

Sep. 1, 1978 [DE] Fed. Rep. of Germany ..... 2838173

[51] Int. Cl.[3] ..... B04C 5/103; B07B 7/06

[52] U.S. Cl. ..... 209/23; 209/3; 209/144; 209/250; 209/281; 209/305

[58] Field of Search ..... 209/3, 17, 19, 21–23, 209/30, 31, 144, 250, 274, 281, 305

[56] References Cited

U.S. PATENT DOCUMENTS

| | | | |
|---|---|---|---|
| 414,431 | 11/1889 | Morse | 209/250 X |
| 759,151 | 5/1904 | Benefield | 209/250 |
| 938,656 | 11/1909 | Frickey | 209/21 X |
| 940,827 | 11/1909 | Sheward | 209/144 |
| 1,721,908 | 7/1929 | Heist | 209/144 X |
| 2,361,758 | 10/1944 | De Fligue | 209/144 |
| 2,471,326 | 5/1949 | Hoyt | 209/144 |
| 3,061,098 | 10/1962 | Brezinski | 209/144 X |
| 3,341,011 | 9/1967 | Prescott | 209/144 |

*Primary Examiner*—Ralph J. Hill

*Attorney, Agent, or Firm*—Reed, Smith, Shaw & McClay

[57] ABSTRACT

A cyclone separator for separating heavy particles and dust particles from fibre material. The separator includes a cyclone housing (2), an inlet tube (9) that opens substantially tangentially into the housing (2), an overflow pipe (6) for the removal of cleaned light-weight fibre material, and an underflow outlet (4) for discharging heavy particles and dust particles. To improve dust removal, a sieve member 7, 8 is arranged inside housing (2) substantially co-axial with the housing axis and into which inlet tube (9) opens tangentially. Additionally, pin-studded or spike-studded strips are mounted on an inside face of the cyclone housing or of the sieve member to preliminarily open up the fibre material. A coaxial sieve member having flat bars with vertical upper portions and inwardly-curved lower portions that bound a co-axial lower sieve opening is also provided.

4 Claims, 9 Drawing Figures

CYCLONE SEPARATOR FOR THE REMOVAL OF HEAVY PARTICLES AND DUST PARTICLES FROM FIBRE MATERIAL

BACKGROUND OF THE INVENTION

1. Field of the Invention

The invention relates to a cyclone separator for the removal of heavy particles and dust particles from fibre material. Generally, the material to be cleaned is pneumatically fed to the cyclone separator, through an inlet tube that is substantially tangential to the cyclone housing. The cleaned light-weight fibre material is removed through an overflow immersion or dip pipe and the heavy particles and dust particles are discharged through an underflow or apical nozzle or outlet.

2. Description of the Prior Art

The kind of equipment described herein is employed during pneumatic conveyance of fibre material to remove from the fibre material particles of foreign matter that are specifically heavier than the fibre material in which they are contained. Typically, this kind of cyclone separator is inserted in front of a cleaning machine as, for example, in cotton waste cleaning systems. It has been established that not only specifically heavier foreign-matter particles are removed this way, but, beyond this, a certain proportion of dust and shell particles are removed.

SUMMARY OF THE INVENTION

According to the invention, the material to be cleaned is pneumatically fed to a cyclone separator which separates heavy particles and dust particles from the fibre material. The material is fed through an inlet tube that is substantially tangential to the cyclone housing. The cleaned light-weight fibre material is removed by an overflow immersion or dip pipe and the heavy particles and dust particles are discharged from an underflow or apical nozzle or outlet. The inlet tube opens tangentially on a sieve sleeve or sieve member that is arranged inside the cyclone housing in substantially coaxial arrangement with the cyclone housing axis. Because of the high flow-in velocity at the region of tangential blowing-in or injection of the material, the sieve sleeve or member insert causes a higher degree of dust removal than realized by prior-art cyclone separators.

The cyclone separator is based mainly on the principle that the dust particles are thrown outwards, i.e. through the sieve sleeve or member, by centrifugal forces established by the swirling or turbulent nature of the flow of the pneumatically fed-in material on entry into the sieve sleeve or member insert. These particles are conveyed into an annular gap between the sieve sleeve or member and the cyclone housing proper and are prevented from returning to the fibre material stream by a clear spatial separation between the space inside the sieve sleeve or member and the annular space between the sieve sleeve or member and the annular housing containing the particles already separated out. As is known, the light-weight fibre material is passed downwards by centrifugal force and is then drawn off upwards in a sharp angle through the so-called overflow immersion or dip pipe for subsequent conveyance further on. The foreign matter particles with a larger specific weight together with the dust are settled out in a dust collecting vessel. Preferably, a substantially constant pressure is maintained inside the cyclone separator by a pendulum sluice or lock, a cellular wheel sluice or lock, or a slide valve arrangement preferably comprising two spaced-apart slide valves or gates located adjacent the underflow or apical nozzle or outlet such that the dust collecting vessel is separated from the cyclone separator.

The sieve sleeve or member can consist of woven wire or perforated sheet metal or be in the form of a sieve grating in which the grate bars extend preferably obliquely to the direction of entry. Such a sieve grating insert provides a larger resistance to the incoming material stream, such that dust removal is further improved. The further addition of pin-studded or spike-studded strips preliminarily opens up the material to provide further improved dust removal efficiency. These pin-studded or spike-studded strips are preferably mounted on an inside face of the sieve sleeve or member such that they extend in axial direction.

Since the degree of dust removal is substantially influenced by the inlet velocity of the fed-in material stream, the inlet tube can be such that its cross-section tapers down in nozzle-like manner towards the sieve sleeve or member.

Other details, objects and advantages of the invention will become apparent as the following description of a presently preferred embodiment proceeds.

BRIEF DESCRIPTION OF THE DRAWINGS

The accompanying drawings show, by way of example, several embodiments of the invention in which.

DESCRIPTION OF THE PREFERRED EMBODIMENT

Figure 1:
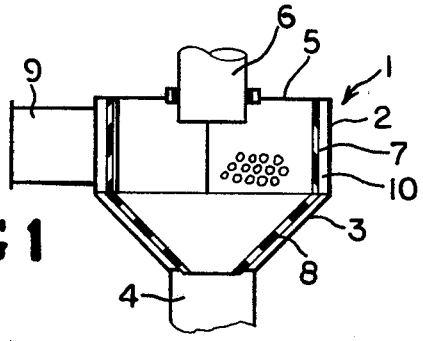
FIG. 1 is an axial section of a first embodiment of a cyclone separator constructed in accordance with the invention.

Referring to the drawings, the cyclone separator shown in FIG. 1 includes a cyclone housing 1 having a substantially cylindrical housing part 2 adjoined by a truncated cone shaped housing part 3 that merges into an underflow or apical nozzle 4. The top of the cylindrical housing part 2 is closed by a cover 5, through which there passes coaxially an overflow immersion or dip pipe 6 opening inside the housing part 2. In the cyclone housing 1 there is inserted a sieve sleeve comprising a cylindrical sieve sleeve section 7 with an adjoining truncated cone shaped sieve sleeve section 8 which opens into the underflow nozzle 4. An inlet tube 9 for the pneumatic feeding-in of the material required to be cleaned opens tangentially through the cylindrical housing part 2 into the cylindrical sieve sleeve section 7.

The separation is basically effected under the action of centrifugal forces produced by the tangential injection of the material required to be separated into the cyclone housing, more specifically into the sieve sleeve.

The tangentially injected material stream forms a primary whirl or vortex at the conical wall which effects the separation and removal of the coarse or heavy particles through the apical nozzle located at the tip of the cone, principally through the action of the resultant centrifugal acceleration. The throttle effect of the apical nozzle deflects or turns back the primary whirl into a narrow rising secondary whirl or vortex and leaves the cyclone separator with the fine or lightweight particles in an upwards direction through the overflow immersion or dip pipe 6.

As the material is fed into the space inside the sieve sleeve, dust particles carried in the fibre material stream will be passed through the sieve sleeve 7 through the action of a primary whirl or vortex formed at the inner face of the sieve sleeve and reach an annular space 10 in between the sieve sleeve and the cyclone housing 1. As the result of the spatial separation between the space inside the sieve sleeve and the annular space 10, these dust particles cannot subsequently rejoin the fibre material stream inside the sieve sleeve.

The heavy particles and dust particles separated inside the sieve sleeve unite at the lower end of the conical sieve sleeve section 8 with the particles previously separated into the annular space 10 and are discharged in a downwards direction through the apical nozzle 4.

To promote the building up of a steady pressure relationship inside the cyclone separator, the apical nozzle may be adjoined by a blocking member 11*a* taking for example the form of a pendulum action sluice or lock, cellular wheel sluice or lock, or a slide valve arrangement comprising preferably two spaced apart slide valves or gate members.

Figure 2:
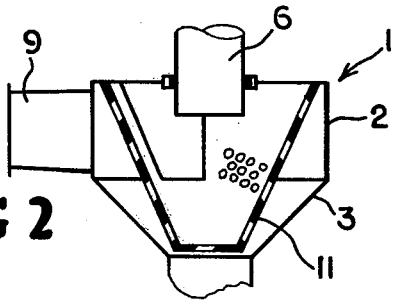
FIG. 2 is an axial section of a second embodiment of a cyclone separator constructed in accordance with the invention.
Figure 6:
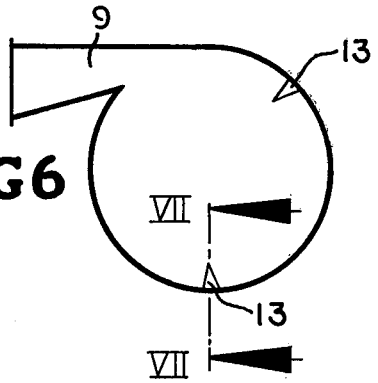

The cyclone separator shown in FIG. 2 differs from the cyclone separator in accordance with FIG. 1 mainly in that an entirely conical, more specifically truncated cone shaped, sieve sleeve 11 into which the inlet tube 9 opens tangentially has been fitted into the cyclone housing 1.

Figure 3:
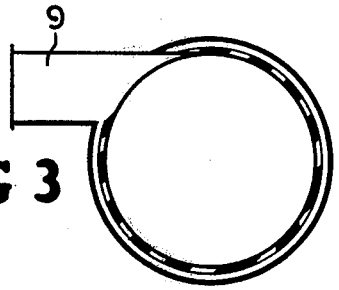
Figure 7:
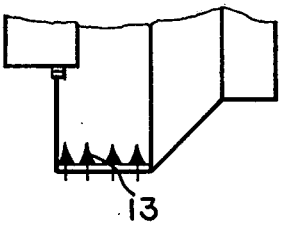
FIG. 7 is a sectional view on the line VII—VII, FIG. 6.
Figure 4:
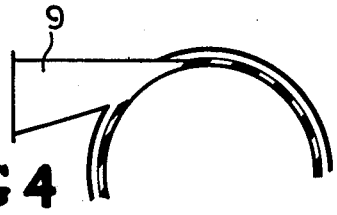

In the manner shown in FIGS. 3 and 4, the inlet tube 9 may have a substantially uniform effective cross-section (FIG. 3) or may have a cross-section which tapers down in nozzle-like manner towards the sieve sleeve (FIG. 4) to influence the inlet velocity of the material stream injected into the cyclone separator.

Figure 5:
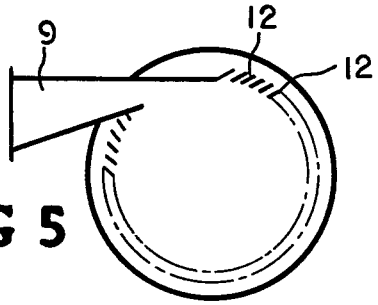
FIGS. 3 to 6 are horizontal sections of various embodiments of the cyclone separator.

FIGS. 1 to 4 show diagrammatic drawings of sieve sleeves in the form of woven wire or perforated sheet metal inserts. In the case of the embodiment in accordance with FIG. 5, the sieve sleeve takes the form of a sieve grating preferably with grate bars 12 which extend obliquely to the direction of entry of the injected material.

Also it is possible to fit axially extending pin-studded or spike-studded strips 13 on the inner wall of the cyclone separator to preliminarily open up the injected fibre material. These pin- or spike-studded strips can be provided in a cyclone separator not having a sieve sleeve insert or sieve member or they can also be provided in conjunction with the sieve sleeve insert or sleeve member in which case they could be arranged on the inner surface or surfaces of the sieve sleeve or member.

Experiments have shown that it is possible to achieve with a cyclone separator constructed in accordance with the invention a substantially greater degree of dust removal than is possible with conventional cyclone separators not fitted with a sieve sleeve insert.

Figure 8:
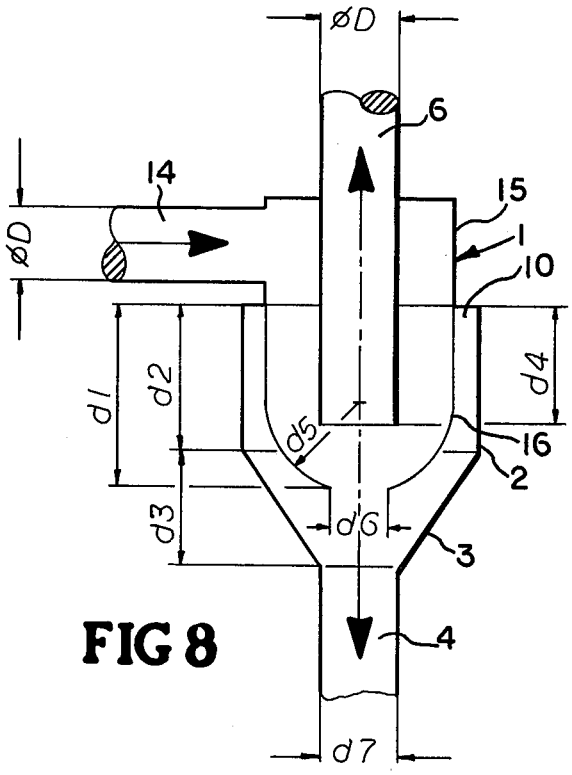
FIG. 8 is a diagrammatic sectional view of a further embodiment of a cyclone separator constructed in accordance with the invention.
Figure 9:
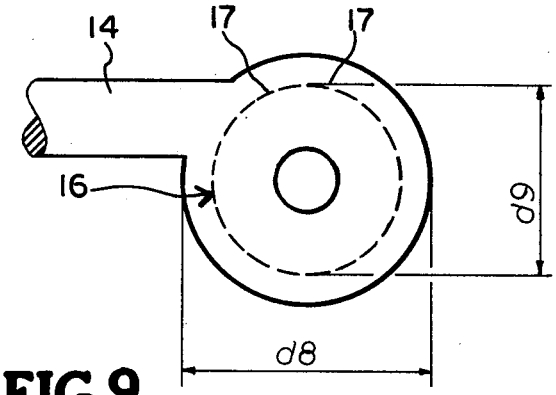
FIG. 9 is a diagrammatic horizontal section of the cyclone separator shown in FIG. 8.

The cyclone separator shown in FIG. 8 is divided into two portions, namely a blow-in or injector portion and a separator portion proper. The blow-in or injector portion comprises a cylindrical solid sheet-metal casing 15, into which an inlet tube 14 opens substantially tangentially. The solid sheet-metal casing 15 is adjoined at the bottom by a sieve sleeve 16 of grating form. This sieve sleeve 16 is made up of vertically-arranged flat bars 17 that do not have lateral connections. The flat bars 17 are tangentially arranged, in the manner shown diagrammatically in FIG. 9, and are not positioned obliquely as in the case of the embodiment shown in FIG. 5. The lower ends of the flat bars 17 are bent or curved inwards to form substantially the shape of a balloon and terminate along a line bounding the periphery of a circular opening which is left free. The flat bars 17 have a tapering-down or decreasing width from top to bottom.

In conformity with FIG. 8 the overflow immersion or dip pipe 6 passes co-axially through the solid sheet-metal casing 15 into the sieve sleeve 16 and cylindrical housing section 2.

It has been found that certain dimensional relationships between individual structural elements of the cyclone separator have proved particularly advantageous in achieving optimum separating action.

The following are preferred relative dimensions for the further structural elements of the cyclone separator for a given diameter D for the inlet tube 14 and the overflow immersion or dip pipe 6:

Overall height of the sieve sleeve—2.2 D
Height d2 of cylindrical housing section 2—1.8 D
Height d3 of coned housing section 3—1.6 D
Immersion depth d4 of the overflow immersion or dip tube 6 into sieve sleeve 16—1.5 to 2 D
Radius of curvature d5 of lower, balloon-shaped, sieve sleeve section—1.2 D
Diameter d6 of lower opening of the sieve sleeve—0.8 D
Internal diameter d7 of the underflow or apical nozzle or outlet 4—0.8 D
Diameter d8 of cylindrical housing section 2—3 D
Diameter d9 of solid sheet-metal casing 15 and of the cylindrical part of the sieve sleeve—2.4 D While presently preferred embodiments of the invention have been shown and described, it is to be understood that the invention is not limited thereto but can be otherwise variously embodied within the scope of the following claims.

I claim:

1. A cyclone separator for separating heavy particles and dust particles from fibre material, said separator comprising:

a cyclone housing;

a sieve sleeve or sieve member arranged inside the cyclone housing, said sieve member being substantially coaxial with the cyclone housing axis and having downwardly-extending flat bars the upper portions of which are arranged vertically, and the lower ends of which are bent or curved inwardly to form a substantially balloon-shaped sieve region that bounds a co-axial lower sieve opening;

an inlet tube that opens substantially tangentially into the cyclone housing and into the sieve member for the pneumatic feeding-in of the material to be cleaned;

an overflow immersion or dip pipe for the removal of cleaned light-weight fibre material; and an underflow or apical nozzle or outlet for discharging heavy particles and dust particles.

2. A cyclone separator as claimed in claim 1 wherein the flat bars are oriented tangentially along the periphery of the sieve member and their width tapers down or decreases from top to bottom.

3. A cyclone separator as claimed in claim 1 wherein the sieve member is adjoined at the top by a solid sheet metal casing into which the inlet tube opens tangentially and through which passes, coaxial within the sieve member, the overflow pipe.

4. A cyclone separator as claimed in claim 4 wherein, for a given diameter D of the inlet tube and of the overflow pipe, there are the following further dimensions:

Overall height of the sieve sleeve—2.2 D
Height d2 of cylindrical housing section 2—1.8 D
Height d2 of coned housing section 3—1.6 D
Immersion depth d4 of the overflow immersion or dip tube 6 into sieve sleeve 16—1.5 to 2 D
Radius of curvature d5 of lower, balloon-shaped, sieve sleeve section—1.2 D
Diameter d6 of lower opening of the sieve sleeve—0.8 D
Internal diameter d7 of the underflow or apical nozzle or outlet 4—0.8 D
Diameter d8 of cylindrical housing section 2—3 D
Diameter d9 of solid sheet-metal casing 15 and of the cylindrical part of the sieve sleeve—2.4 D

* * * * *